US005154421A

United States Patent [19]

Hamano

[11] Patent Number: 5,154,421

[45] Date of Patent: Oct. 13, 1992

[54] STOP-CONTROL METHOD OF REELS IN A ROTARY GAMING MACHINE AND ITS APPARATUS

[75] Inventor: Junichi Hamano, Osaka, Japan

[73] Assignee: Takasago Electric Industry Co., Ltd., Osaka, Japan

[21] Appl. No.: 628,317

[22] Filed: Dec. 17, 1990

[30] Foreign Application Priority Data

Jul. 31, 1990 [JP] Japan ..... 2-204085

[51] Int. Cl.[5] ..... A63F 5/04

[52] U.S. Cl. ..... 273/143 R; 273/138 A

[58] Field of Search ..... 273/143 R, 138 A

[56] References Cited

U.S. PATENT DOCUMENTS 4,573,681 3/1986 Okada ..... 273/143 R
4,695,053 9/1987 Vazquez et al. ..... 273/143 R
4,711,451 12/1987 Pajak et al. ..... 273/143 R
4,772,023 9/1988 Okada ..... 273/143 R
4,858,932 8/1989 Keane ..... 273/143 R

*Primary Examiner*—Benjamin Layno

[57] ABSTRACT

The present invention relates to a method and its apparatus for controlling stop action of the rotary units in a rotary type gaming machine such as a slot machine. According to the method and the apparatus of the present invention, the appearance rate of each symbol of the reel at the stop position can be controlled at will by allotting a voluntarily set weighting to each symbol shown on the rotary unit prior to the execution of a game, and during the game, it can make appear and stop either one of the symbols at the aforementioned stop position with an appearance rate corresponding to the allotted weighting. By means of this, it is made possible to change the payout rate with an extremely simple work.

8 Claims, 10 Drawing Sheets

FIG. 2 BLOCK DIAGRAM SHOWING CIRCUIT CONFIGURATION OF A SLOT MACHINE

FIG. 3 BLOCK DIAGRAM SHOWING CIRCUIT CONFIGURATION OF A SLOT MACHINE

FIG. 4

| | |
|---|---|
| 1 | T C |
| 2 | — |
| 3 | 1 B |
| 4 | — |
| 5 | 3 B |
| 6 | — |
| 7 | R C |
| 8 | — |
| 9 | 2 B |
| 10 | — |
| 11 | 1 B |
| 12 | — |
| 13 | B C |
| 14 | — |
| 15 | 2 B |
| 16 | — |
| 17 | 1 B |
| 18 | — |
| 19 | G C |
| 20 | — |
| 21 | 3 B |
| 22 | — |

FIG.7

| SC | n | 1ST REEL | | 2ND REEL | | 3RD REEL | | Wn |
|---|---|---|---|---|---|---|---|---|
| | | $W_{1n}$ | $P_{1n}$ | $W_{2n}$ | $P_{2n}$ | $W_{3n}$ | $P_{3n}$ | |
| 1 | 0 | 1 | 1/34 | 1 | 1/34 | 1 | 1/34 | 1 |
| 2 | 1 | 2 | 2/34 | 2 | 2/34 | 2 | 2/34 | 8 |
| 3 | 2 | 5 | 5/34 | 7 | 7/34 | 6 | 6/34 | 210 |
| 4 | 3 | 1 | 1/34 | 1 | 1/34 | 1 | 1/34 | 1 |
| 5 | 4 | 4 | 4/34 | 3 | 3/34 | 3 | 3/34 | 36 |
| 6 | 5 | 1 | 1/34 | 1 | 1/34 | 1 | 1/34 | 1 |
| 7 | 6 | 2 | 2/34 | 3 | 3/34 | 2 | 2/34 | 12 |
| 8 | 7 | 1 | 1/34 | 1 | 1/34 | 2 | 2/34 | 2 |
| 9 | 8 | 4 | 4/34 | 4 | 4/34 | 5 | 5/34 | 80 |
| 10 | 9 | 1 | 1/34 | 1 | 1/34 | 1 | 1/34 | 1 |
| 11 | 10 | 1 | 1/34 | 1 | 1/34 | 1 | 1/34 | 1 |
| 12 | 11 | 2 | 2/34 | 1 | 1/34 | 1 | 1/34 | 2 |
| 13 | 12 | 1 | 1/34 | 2 | 2/34 | 2 | 2/34 | 4 |
| 14 | 13 | 1 | 1/34 | 1 | 1/34 | 1 | 1/34 | 1 |
| 15 | 14 | 5 | 5/34 | 3 | 3/34 | 2 | 2/34 | 30 |
| 16 | 15 | 1 | 1/34 | 1 | 1/34 | 2 | 2/34 | 2 |
| 17 | 16 | 1 | 1/34 | 1 | 1/34 | 1 | 1/34 | 1 |
| $TW_x$ | | 34 | 1 | 34 | 1 | 34 | 1 | |

FIG. 8

| TB1 | | TB2 | | TB3 | |
|---|---|---|---|---|---|
| 1ST REEL | | 2ND REEL | | 3RD REEL | |
| S C | m | S C | m | S C | m |
| 1 | 0 | 1 | 0 | 1 | 0 |
| 2 | 1 – 2 | 2 | 1 – 2 | 2 | 1 – 2 |
| 3 | 3 – 7 | 3 | 3 – 9 | 3 | 3 – 8 |
| 4 | 8 | 4 | 10 | 4 | 9 |
| 5 | 9 – 12 | 5 | 11 – 13 | 5 | 10 – 12 |
| 6 | 13 | 6 | 14 | 6 | 13 |
| 7 | 14 – 15 | 7 | 15 – 17 | 7 | 14 – 15 |
| 8 | 16 | 8 | 18 | 8 | 16 – 17 |
| 9 | 17 – 20 | 9 | 19 – 22 | 9 | 18 – 22 |
| 10 | 21 | 10 | 23 | 10 | 23 |
| 11 | 22 | 11 | 24 | 11 | 24 |
| 12 | 23 – 24 | 12 | 25 | 12 | 25 |
| 13 | 25 | 13 | 26 – 27 | 13 | 26 – 27 |
| 14 | 26 | 14 | 28 | 14 | 28 |
| 15 | 27 – 31 | 15 | 29 – 31 | 15 | 29 – 30 |
| 16 | 32 | 16 | 32 | 16 | 31 – 32 |
| 17 | 33 | 17 | 33 | 17 | 33 |

FIG.9 FLOW CHART SHOWING CONTROL PROCESSES OF A SLOT MACHINE

FIG.10

(1)

| | |
|---|---|
| 1 | T C |
| 2 | — |
| 3 | 1 B |
| 4 | — |
| 5 | 3 B |
| 6 | — |
| 7 | R C |
| 8 | — |
| 9 | 2 B |
| 10 | — |
| 11 | 1 B |
| 12 | — |
| 13 | B C |
| 14 | — |
| 15 | 2 B |
| 16 | — |
| 17 | 1 B |
| 18 | — |
| 19 | G C |
| 20 | — |
| 21 | 3 B |
| 22 | — |

(2)

| | |
|---|---|
| 1 | T C |
| 2 | — |
| 3 | 1 B |
| 4 | 1 B |
| 5 | — |
| 6 | 3 B |
| 7 | 3 B |
| 8 | — |
| 9 | R C |
| 10 | R C |
| 11 | — |
| 12 | 2 B |
| 13 | 2 B |
| 14 | — |
| 15 | 1 B |
| 16 | 1 B |
| 17 | — |
| 18 | B C |
| 19 | B C |
| 20 | — |
| 21 | 2 B |
| 22 | 2 B |
| 23 | — |
| 24 | 1 B |
| 25 | — |
| 26 | G C |
| 27 | G C |
| 28 | G C |
| 29 | G C |
| 30 | G C |
| 31 | — |
| 32 | 3 B |
| 33 | 3 B |
| 34 | — |

STOP-CONTROL METHOD OF REELS IN A ROTARY GAMING MACHINE AND ITS APPARATUS

TECHNICAL FIELD

The present invention relates to a stop-control method applicable to reels or such rotary units in a rotary game machine such as a slot machine and its apparatus.

DESCRIPTION OF PRIOR ART

In a conventional slot machine, which has three reels provided with multiple symbols on their peripheral side surface, all reels start rotating in unison with a starting handle after the player shoots a coin or coins, and each reel is stopped one by one after lapse of a certain time. As the result, one symbol or another for each reel will appear on the stop line, and the game and the payout rate of coins are decided according to a particular combination of symbols that may be obtained. In a typical slot machine, 22 units of aforementioned symbols, for example, are provided per each reel. And the probability in the appearance of a certain combination of symbols and the payout amount of coins in such occasion will decide the payout rate.

In a conventional slot machine, a tape bearing a certain number of symbols is pasted on the peripheral side surface of reel. In order to change the payout rate, it is necessary that the tape be replaced with a different tape bearing different number of symbols or the payout number of coins be changed.

FIG. 10(1) shows an example of an arrangement of symbols to be described on the peripheral side surface of the reel. In said example, the number of symbols is 22, which include symbols relating to winning marks such as TC, IB and 3B, and symbols having any winning game represented by the mark —. When the machine has three reels having this kind of arrangement of symbols, the total number of combinations of symbols makes $22\times22\times22=10{,}648$.

In a slot machine having reels of this kind, it is necessary, in order to change the payout rate of coins, to change the reels provided with a different arrangement of symbols as shown in FIG. 10 (2). In the case of said drawing, with the symbols given 34, the total number of combinations makes $34\times34\times34=39304$.

For changing the payout rate of coins, besides replacing the tape with different number of symbols by changing the tape on the reels, it is possible to do so by making virtual reels having a different number of symbols in the program and let them virtually rotate and stop a certain symbol on the virtual stop line. In this case, it means that the reels are controlled in a manner so that the symbols coinciding with the ones on the virtual stop line stops on the actual stop line.

In this case, however, it is necessary to make virtual reels at every time when the reels are replaced with the ones having different number of symbols, meaning that this kind of works are extremely troublesome.

BRIEF DESCRIPTION OF THE INVENTION

The present invention is characterized in that it relates to a controlling method of rotary units in a rotary gaming machine in controlling the stop action of the rotary units in stopping a certain symbol among a multiple number of symbols at a predetermined stop position, and particularly in that, prior to starting a game, a process is set up to determine the number of appearances of each symbol at the stop position by allotting a voluntary weighting to each symbol, and a process in a game whereby a certain symbol having been allotted with above-mentioned weighting allotted in accordance with the first process is stopped at the aforementioned stop position.

The present invention relates to a stop-control apparatus of rotary units in a rotary gaming machine which is provided with drive units, a memory and control units. Above-mentioned rotary units are represented with a multiple number of symbols around the periphery. Above-mentioned drive units have a rotational drive power source which drives and stops the reels causing a certain symbol to stop and appear at the predetermined stop position Above-mentioned memory unit memorizes data of the allotted weighting to each symbol. Above-mentioned control unit control the drive unit according to the data memorized in above-mentioned memory unit, and causes to stop and appear at the predetermined stop-position keeping an appropriate appearance rate in accordance with the above-mentioned weighting to each symbol.

It is therefore the purpose of the present invention to offer a stop control method and its apparatus of rotary units in a rotary gaming machine that can change the coin payout rate with an extremely simple work without requiring to make any virtual reel.

According to the present invention, it is sufficient to change the weighting to be allotted to each symbol in order to change to payout rate of coins and enables to change the payout rate with an extremely simple work.

The above-mentioned purpose, characteristics and effectiveness of the present invention can be more evident from the following detailed descriptions made with references to the accompanied drawings.

BRIEF DESCRIPTION OF DRAWINGS

FIG. 4 is a descriptive drawing showing the arrangement of symbols.

FIG. 7 is a descriptive drawing showing an example for setting up the weighting.

FIG. 8 is a descriptive drawing showing an example of a symbol table.

FIG. 10 is a descriptive drawing showing an example of arrangement of symbols and an example of their change.

DETAILED DESCRIPTION OF THE INVENTION

Figure 1:
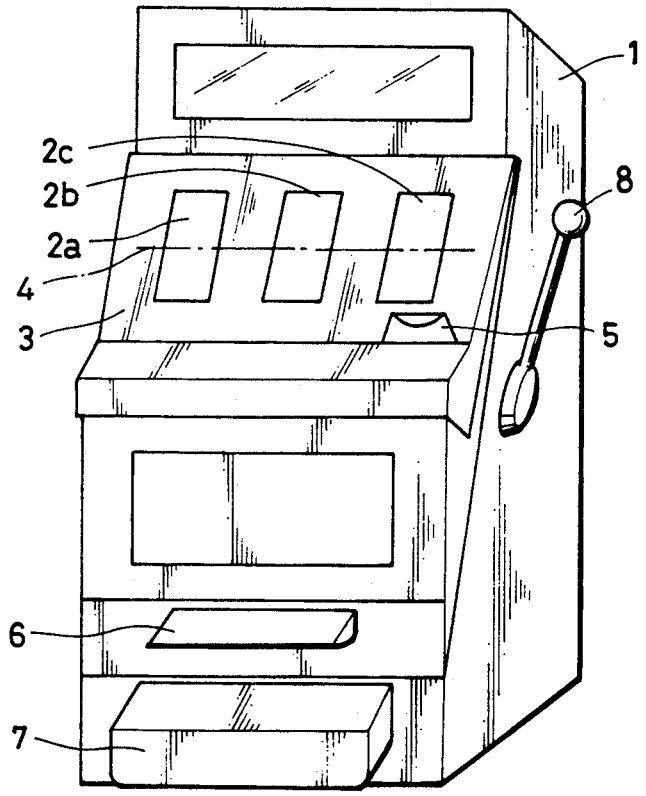
FIG. 1 is a perspective view showing an appearance of a slot machine.

FIG. 1 shows the appearance of the slot machine when the invention is put into embodiment, wherein 3 reels 2*a*, 2*b* and 2*c* are incorporated for arrangement in the interior of the machine. On the peripheral side surface of each reel, a multiple number of symbols are disposed in alignment. From the display window 3 on the front side, one can see each reel rotating. At the center of this display window 3, a the stop line 4 is set, and when reels stop, one symbol per each reel stops on said stop line 4, with one preceding and another following symbols over and below the stop line, respectively.

In the drawing, numeral 5 is the shooting inlet of coins, and numeral 6 is for payout of coins. Numeral 7 is the receiving tray of paid-out coins, while numeral 8 is the operating handle for starting the game.

Figure 2:
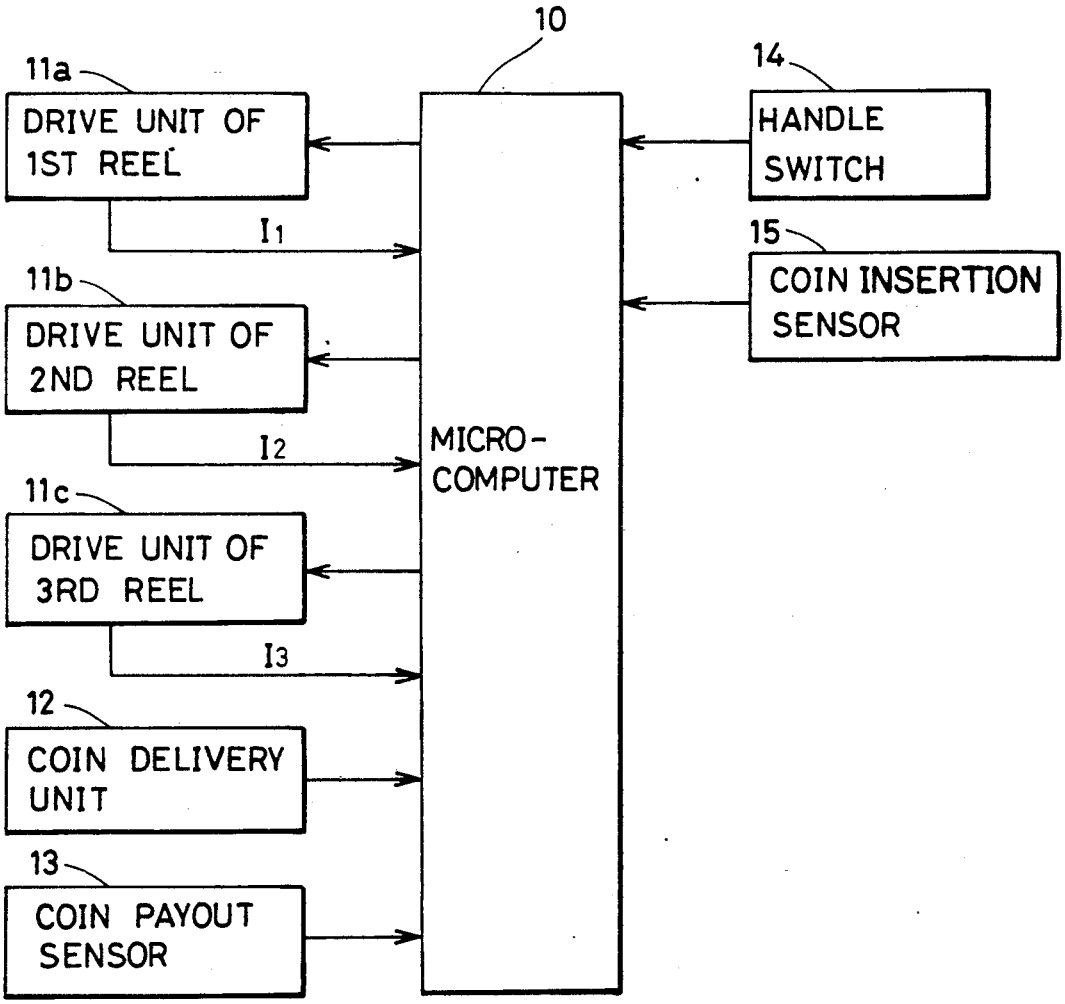
FIG. 2 and 3 are the block diagram showing the configuration of circuits of the slot machine.

FIG. 2 shows an outline of the circuit configuration for the slot machine, connecting it to input/output terminals of the microcomputer 10, which is in charge of control and operation, to each drive unit 11*a*–11*c* of the 1st–3rd reels, coin delivering unit 12, coin releasing sensor 13, handle switch 14, and coin shooting sensor 15. Each of drive units 11*a*–11*c* includes a stepping motor as the drive power source of reels 2*a*–2*c*. Microcomputer 10 furnished drive pulses to each stepping motor, detects the symbols which are at the stop line by counting drive pulses and resetting said counted value of drive pulses with the reference signals $I_1$–$I_3$ showing the reference positions of each reel. Coin delivery unit 12 releases the paid out coins to the coin-release outlet 6, while the coin-release sensor 13 detects the paid out coins. Handle switch 14 turns on the start-handle 8. Coin shoot sensor 15 detects the coins that were shot into the coin shooting inlet 15. Detection signals from the coin releasing sensor 13 and coin shooting sensor 15 are input into the microcomputer 10, which counts the number of coins shot and released.

Figure 3:
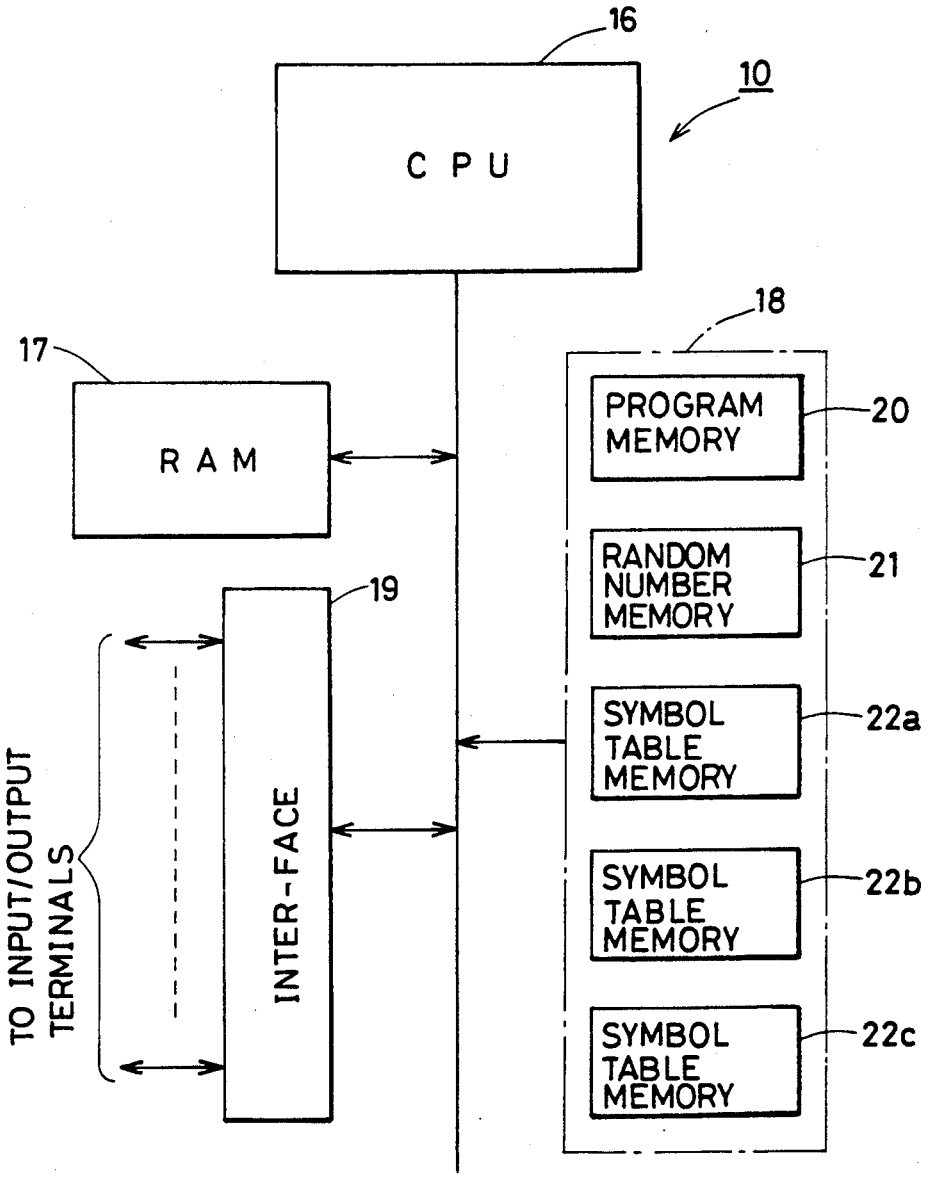

FIG. 3 shows an outline configuration of the microcomputer 10, which includes CPU 16, RAM 17, ROM 18 and interface 19. ROM 18 includes random number memory 21 and symbol table memory 22*a*–22*c* per each reel, which will be described later.

FIG. 4 shows an example of arrangement of symbols described on the peripheral side surface of each reel 2*a*–2*c*. Numeral of 1–22 on the left side column indicates the numbers of symbols in row, while the letters on the right side column indicate the kind of symbols, signs such as TC, 1B and 3B showing the symbols relating to winning games and the mark—showing the symbols not relating to winning games.

Figure 5:
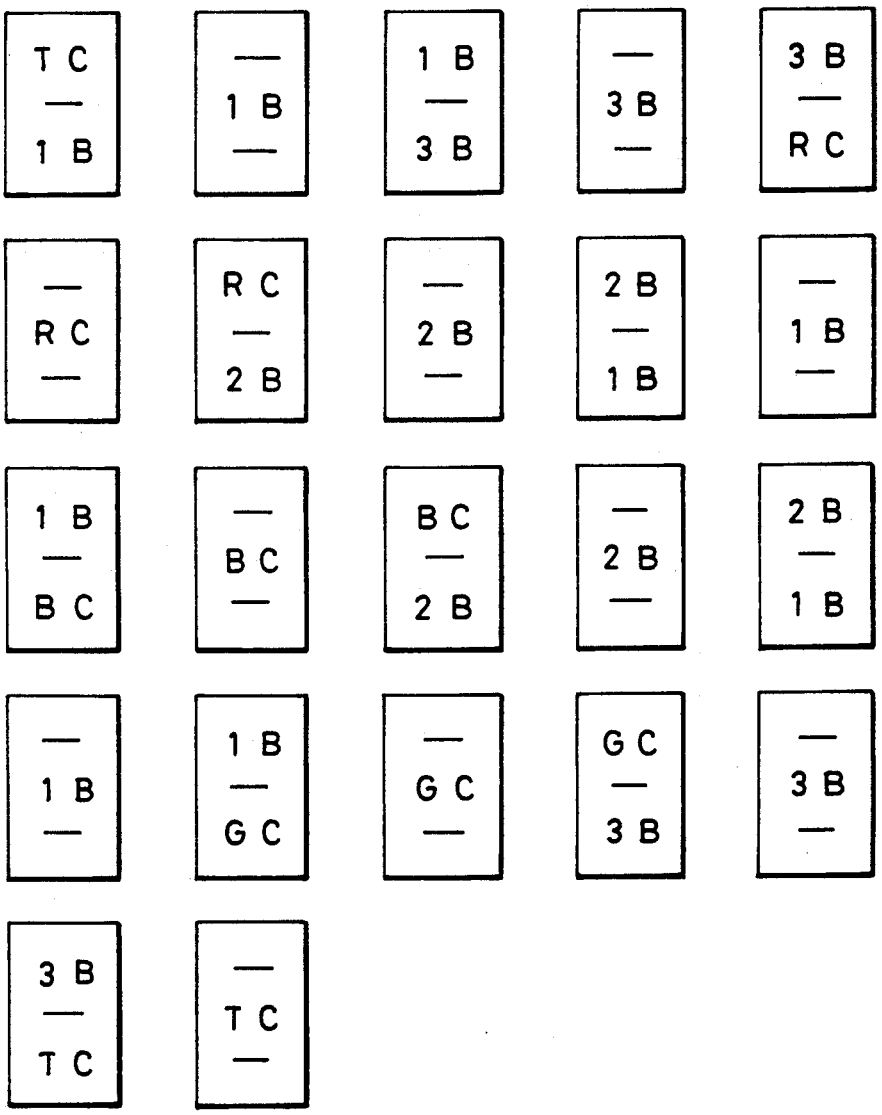
FIG. 5 and 6 are descriptive drawings showing the appearance manner of symbols.
Figure 6:
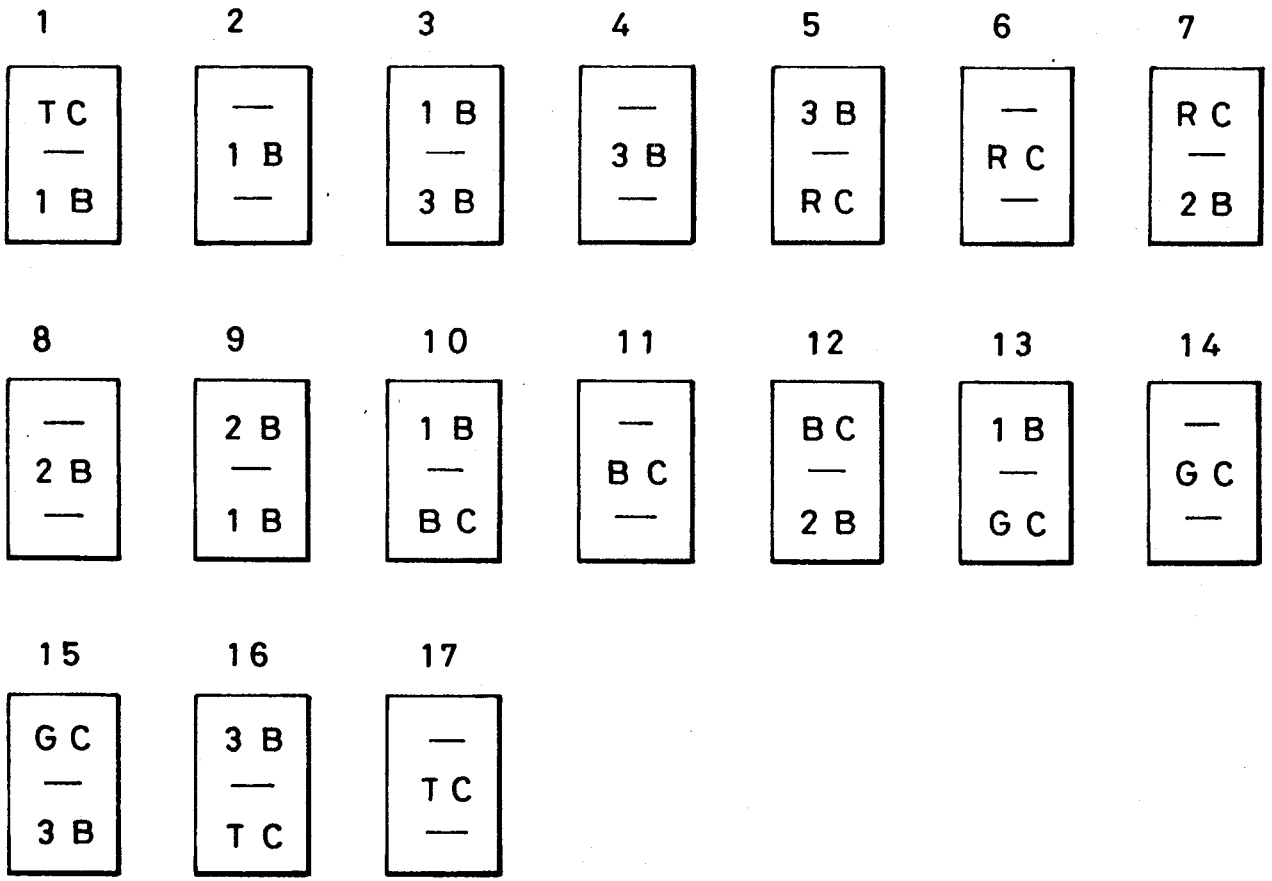

With three symbols appearing in said display window 3, when each reel is at a standstill, there are 22 groups of symbols that appear on the window at one time as shown in FIG. 5. If those duplicating groups are deducted, there remains 17 groups as shown in FIG. 6. Therefore, the total numbers of combination of symbols are; $17 \times 17 \times 17 = 4{,}913$.

In the present example of embodiment, as shown in FIG. 7, the appearance rate p x n of appearing manner of each symbol can be set up at will, by allotting voluntary weighting value $W \times n$ (n being 0, 1, 2, . . . 16) to appearance group SC, assuming reel number to be as x (x being 1, 2 and 3).

In said FIG. 7, TWx indicates the summed up total value of weighting of the reel number x. The summed up total value of weighting each reel of number 1–3, that is $TW_1 - TW_3$ can be obtained in the following equations (1)–(3). And the appearance rate Pxn of each group of symbols is also given by the equation (4).

$$TW_1 = \sum_{n=0}^{16} W_{1n} \quad (1)$$

$$TW_2 = \sum_{n=0}^{16} W_{2n} \quad (2)$$

$$TW_3 = \sum_{n=0}^{16} W_{3n} \quad (3)$$

-continued $$Pxn = Wxn/TWx \quad (4)$$

FIG. 8 shows the relationship between the appearance group of symbols SC and the random number m. Here, the random number m is the number allotted to each symbol in accordance with the weighting value. Therefore, for example, when the weighting value is 2, 2 pieces of random numbers are given; when the weighting value is 5, 5 pieces of random numbers are given.

In the example as given in said FIG. 8, as regards No. 1 reel 2*a*, when the appearance group SC is 1 (SC=1), the weighting value being "1", one piece of number "0" is given as the random number. In the same way, when SC=2, the weighting value being "2", two pieces of following numbers "1"0 and "2" are given as the random numbers.

In the same way, random numbers m corresponding to the summed up weighting values in total are allotted. And these random numbers are stored in the random number memory 21, and symbol table $TB_1$–$TB_3$ with regard to each reel 2*a*–2*c* are stored in symbol table memory 22*a*–22*c* respectively.

Figure 9:
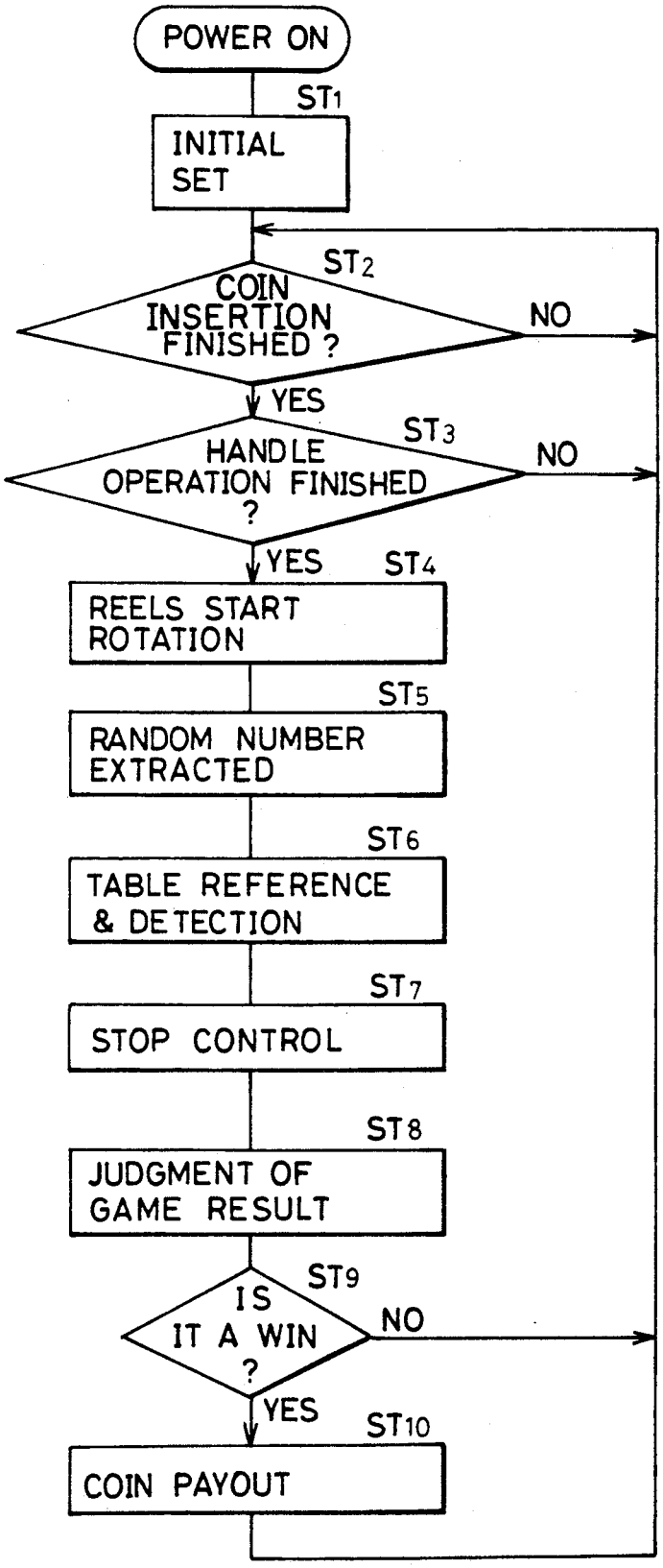
FIG. 9 is a flow chart showing the order of control process of the slot machine.

FIG. 9 shows the processes of control by the microcomputer in above-mentioned microcomputer 10.

First, if the power source is turned on, the microcomputer 10 is set to the initial state. As Step 1 (shown in the drawing as ST1). Next, at Step 2, CPU 16 checks if the coins were shot into from the coin shoot inlet 5. Upon detecting that the coins were shot into by the coin shooting sensor 15, the judgement of detection signal by step 2 turns "Yes", CPU 16 checks if the start handle 8 has been operated as the next Step 3. As the handle switch 14 turns on by the handle operation, the judgement of Step 3 turns "Yes", and CPU 16 starts reels 2*a*–2*c* as the next Step 4. In the following Step 5, each reel extract random number m from the random memory 21.

After detecting appearance state SC of symbol per each reel corresponding to each random number m with reference made to each symbol table 22*a*–22*c* by CPU 16, it controls stop action of drive unit of each reel No. 1–No. 3 so that each reel 2*a*–2*c* will realize the respective appearance state of each reel 2*a*–2*c*, which is Step 7.

As 3 reels of 2*a*–2*c* come to a standstill, CPU 16 judges the combination of symbols having aligned on the stop line 4 in Step 8. If the result is as defined, judgement of Step 9, turns "Yes", which drives the coin payout unit 12 to release the coins of defined payout rate from the coin releasing outlet 6 (being Step 10).

In this way, because it has set up the appearance rate of each symbols at the stop position at will by allotting a voluntary weighting to each symbol of individual reel 2*a*–2*c*, it is sufficient with merely changing the weighting value to each symbol in order to change the payout rate, meaning that it is an extremely simple work for the alteration.

In the above, descriptions were made as regards the favorable embodiment of the present invention. One can implement various variations and amendments without deviating from the basic spirit of the invention. Consequently, the scope of the invention is defined only with the appending claims.

What is claimed is:

1. A stop-control method of rotary units in a rotary type gaming machine, wherein either one of a multiple number of symbols displayed on the above-mentioned rotary units is stopped at a predetermined stop-position, characterized in executing following first and second processes;

the first process being in setting up an appearance rate of each symbol at the stop-position at will by allotting a voluntary weighting to each symbol prior to the execution of a game, and the second process being in realizing to stop either one of the symbols at the above-mentioned stop position in an appearance rate corresponding to the weighting allotted in the first process in the execution of a game.

2. The method of claim 1 further comprising determining a wining following the stopping of said one symbol at the respective stop position.

3. The apparatus of claim 2 further comprising means responsive to the symbols appearing upon stopping of said rotary units for determining a winning.

4. A stop-control method of rotary units in a rotary type gaming machine, being provided with rotary units, drive units, memory and control units; wherein above-mentioned rotary units have a display of a multiple number of symbols around their body, above-mentioned drive units have rotational drive power sources, which drive and stop the rotary units, making either one of the symbols appear at a predetermined stop-position, above-mentioned memory memorizes the data of voluntarily allotted weighting to each symbol, above-mentioned control unit controls the behavior of the drive units according to the memorized data in the memory and stops either one of the symbols at the above-mentioned predetermined stop-position in the appearance data corresponding to the above-mentioned allotted weighting.

5. A stop-control apparatus of rotary units in a gaming machine in a rotary type gaming machine in accordance with claim 2, wherein the above-mentioned rotary type gaming machine is a slot machine, and the above-mentioned rotary units are rolls installed in multiple numbers.

6. A stop-control apparatus of rotary units in a rotary type gaming machine in accordance with claim 2, wherein the above-mentioned drive units have step-motors as their rotationary drive power source, and drive the step-motors with the drive pulse given by the control unit.

7. A stop-control apparatus of rotary units in a rotary type gaming machine in accordance with claim 2, wherein the above-mentioned memory has a symbol table memory memorizing the numbers of random number corresponding to the allotted weighting and corresponding relation between each random number and symbols in addition to the random number memory memorizing all random numbers, and the above-mentioned control unit reads out random number from the random number memory, detects the symbol corresponding to the random number with reference made to the symbol table memory, and make appear the symbol and stops it at the above-mentioned stop-position.

8. The apparatus of claim 4 further comprising means responsive to the symbols appearing upon stopping of said rotary units for determining a winning.

* * * * *